United States Patent [19]

Giguere

[11] Patent Number: 4,790,108

[45] Date of Patent: Dec. 13, 1988

[54] WEATHER STRIP

[75] Inventor: Jean P. Giguere, Lotbiniere, Canada

[73] Assignee: Donat Flamand Inc., Quebec, Canada

[21] Appl. No.: 46,199

[22] Filed: May 5, 1987

[51] Int. Cl.[4] ..... E06B 7/16

[52] U.S. Cl. ..... 49/484; 49/485

[58] Field of Search ..... 49/480, 483, 484, 485, 49/406

[56] References Cited

U.S. PATENT DOCUMENTS

| | | | |
|---|---|---|---|
| 2,165,399 | 7/1939 | McCormick | 49/493 |
| 2,528,264 | 10/1950 | Coppock | 49/499 |
| 2,592,861 | 4/1952 | Close . | |
| 3,276,167 | 10/1966 | Bus . | |
| 3,324,597 | 6/1967 | Rich | 49/483 |
| 3,378,958 | 4/1968 | Parks . | |
| 3,504,456 | 4/1970 | Frederick, Jr. . | |
| 3,521,404 | 7/1970 | Hager . | |
| 3,672,424 | 6/1972 | Brown . | |
| 3,761,347 | 9/1973 | Yackiw . | |
| 3,851,420 | 12/1974 | Tibbetts . | |
| 3,854,246 | 12/1974 | McAllister . | |
| 4,006,562 | 2/1977 | Belanger . | |
| 4,255,902 | 3/1981 | Ruff . | |
| 4,310,991 | 1/1982 | Seely . | |
| 4,510,715 | 4/1985 | Giguere . | |

FOREIGN PATENT DOCUMENTS

| | | |
|---|---|---|
| 920991 | 3/1963 | United Kingdom . |

*Primary Examiner*—Kenneth J. Dorner
*Assistant Examiner*—Gerald A. Anderson
*Attorney, Agent, or Firm*—Cushman, Darby & Cushman

[57] ABSTRACT

The present invention relates to a weather-strip to be used for doors or windows having sliding panels, more particularly on the meeting uprights of the panels. The weather-strip consists of a rigid base in the form of an inverted T from which two sealing wings run, generally parallel, each comprising an inner portion connected to the base, an outer portion and a curved intermediate part which connects the inner portion to the outer portion. The outer portion is offset in relation to the inner portion, in a generally transversal direction to the wings.

10 Claims, 3 Drawing Sheets

46
47
47
46
36
32
44
34
52
56
54
35
38
42
10
50
40
50
10
56
54
42
52
44
46
47
47
46
48
37
48

WEATHER STRIP

FIELD OF THE INVENTION

The present invention relates to a weather-strip adapted to be used in doors or windows, particularly windows having sliding panels primarily for domestic use.

BACKGROUND OF THE INVENTION

Doors or windows having one or more sliding panels are today in current use in dwellings. It is well known that with doors or windows of this type, when the sliding panel is in the closed position there is always a small space between the edge of the panel and the upright of the frame against which the sliding panels rests, or between the meeting uprights of the panels. This space often allows air to penetrate into the interior of the dwelling, and this increases heating costs, all the more so in severe climates.

Many weather-strips have been developed in the past for the purpose of eliminating this entry of air. These weather-strips are, however, deficient in many respects and, in most cases, they do not produce the anticipated results. For example, it is well known that one of the main properties of a weather-strip is that it shall be flexible and shall return to its original shape after a series of opening and closing cycles of the panel, so that it will provide a satisfactory seal and prevent the entry of air after several months of service. Now, conventional weather-strips tend to shrink, split or crack after a certain length of time, after which they only partly fulfill their function.

For the purpose of overcoming the problems of premature wear in existing weather-strips, consideration was given to the production of a weather strip which, when the sliding panel is in the closed position, is applied firmly to the frame of the panel in order to compensate for possible shrinkage of the weather-strip due to aging. However, this solution of the problem is far from ideal, since it increases the resistance of the sliding panel to displacement because of the increase in friction between it and the weather-strip.

OBJECTS AND STATEMENT OF THE PRESENT INVENTION

An object of the present invention is to provide an improved weather-strip for doors or windows.

The weather-strip according to the present invention comprises a relatively rigid base which makes it possible to fit the weather-strip in the desired location. Two thin, sealing wings extend from the base side by side, each wing comprising an inner portion connected to the base, an outer sealing portion, and a curved intermediate portion which interconnects the inner portion of the wing to the outer portion thereof. The outer portion is offset in relation to the inner portion, in a generally transverse direction to the sealing wings.

The weather-strip according to the present invention may be used advantageously in a domestic door or window, having sliding panels, of the type which carries, along one of its edges, a projecting tongue adapted to fit in a housing in the form of a groove when the sliding panel is in the closed position. More particularly, the projecting tongue may be formed along the edge of the panel which rests against the upright of the frame while the groove which accommodates the tongue is formed in the upright itself.

In a similar manner, the projecting tongue may be formed along the meeting upright of the panel, coming to rest in a groove formed in the meeting upright of the adjacent panel.

The weather-strip according to the invention in a first embodiment is mounted in the groove which accommodates the projecting tongue in such a manner that the two sealing wings extend perpendicularly to the tongue. When the latter enters the groove, the two wings bear upon the tongue and enclose an air-space which acts as a thermal barrier.

In an alternative arrangement, the weather strip may be mounted to the tongue so that the sealing wings engage the inner walls of the groove when the tongue penetrates the groove.

Since the two sealing wings are supple and pliable, they provide a satisfactory seal and, at the same time, they do not unduly impede the displacement of the sliding panel.

Therefore, the present invention comprises in a general aspect of a weather-strip for a door or a window including at least one sliding panel movable into a frame to a closed position in which an edge of the sliding panel meets an elongated member, the elongated member and the edge defining a pair of mating elements, the weather strip comprising:

an elongated base made of a relatively rigid material;

two sealing wings made of a relatively flexible material and being mounted to the elongated base, said wings extending side by side from said base and being slightly spaced apart, each sealing wing comprising:

(a) an inner portion connected to the base and projecting therefrom;

(b) an outer sealing portion; and (c) a curved intermediate portion connecting the outer sealing portion to the inner portion, the outer sealing portion being offset with respect to the inner portion in a generally transverse direction with respect to the sealing wings, the weather strip being adapted to be mounted to one of the mating elements, the sealing wings being spaced apart from each other so as to define therebetween an air space which constitutes a thermal barrier when the sliding panel is in the closed position with the outer portion of each wing engaging the other of the mating elements.

DESCRIPTION OF A PREFERRED EMBODIMENT

These characteristics and certain others, as well as the advantages of weather-strip according to the present invention will become apparent upon reading the following description of a preferred embodiment, in conjunction with the drawings attached hereto, wherein.

Figure 1:
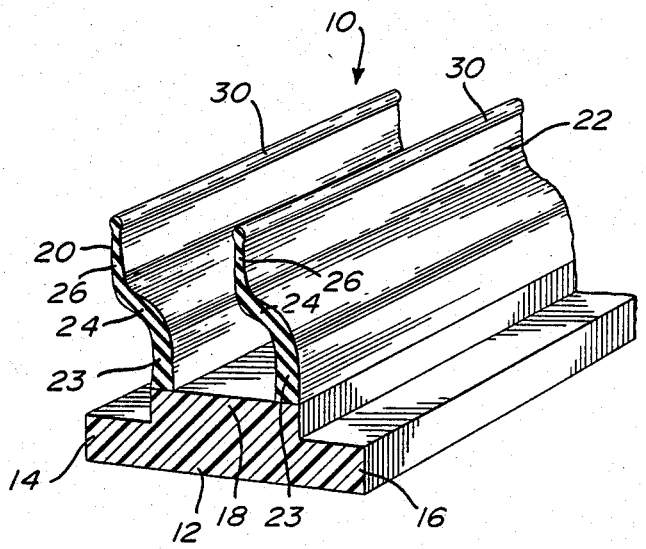
FIG. 1 is an enlarged perspective view of a weather-strip according to the invention.

Composite weather-strip 10, illustrated in FIG. 1, comprises a base 12 in the form of an inverted T, with a pair of horizontal arms 14 and 16 and a projecting vertical strip identified by the reference numeral 18. Base 12 is made of a relatively rigid plastic material which allows the weather-strip to be secured adequately to a support. In one specific embodiment of the invention, the base 12 may have a width of the order of 0.257 of an inch and a height of about 0.07 of an inch.

Two tapered sealing wings, 20 and 22 respectively, are mounted upon the upper surface of vertical strip 18. These wings, which, as may be gathered from the figure, are generally parallel and are made of a rubbery material which is distinctly more pliable than the material of base 12.

Each wing comprises of an inner portion 23, which is generally perpendicular to the upper surface of the vertical strip 18 and tapers in a direction away from the latter. Furthermore, each wing comprises a curved intermediate portion 24 and a relatively thin outer portion 26 which is generally parallel with the lower inner portion 23. According to a preferred embodiment of the invention, the trailing edge of each wing is provided with a bead 30.

Figure 2:
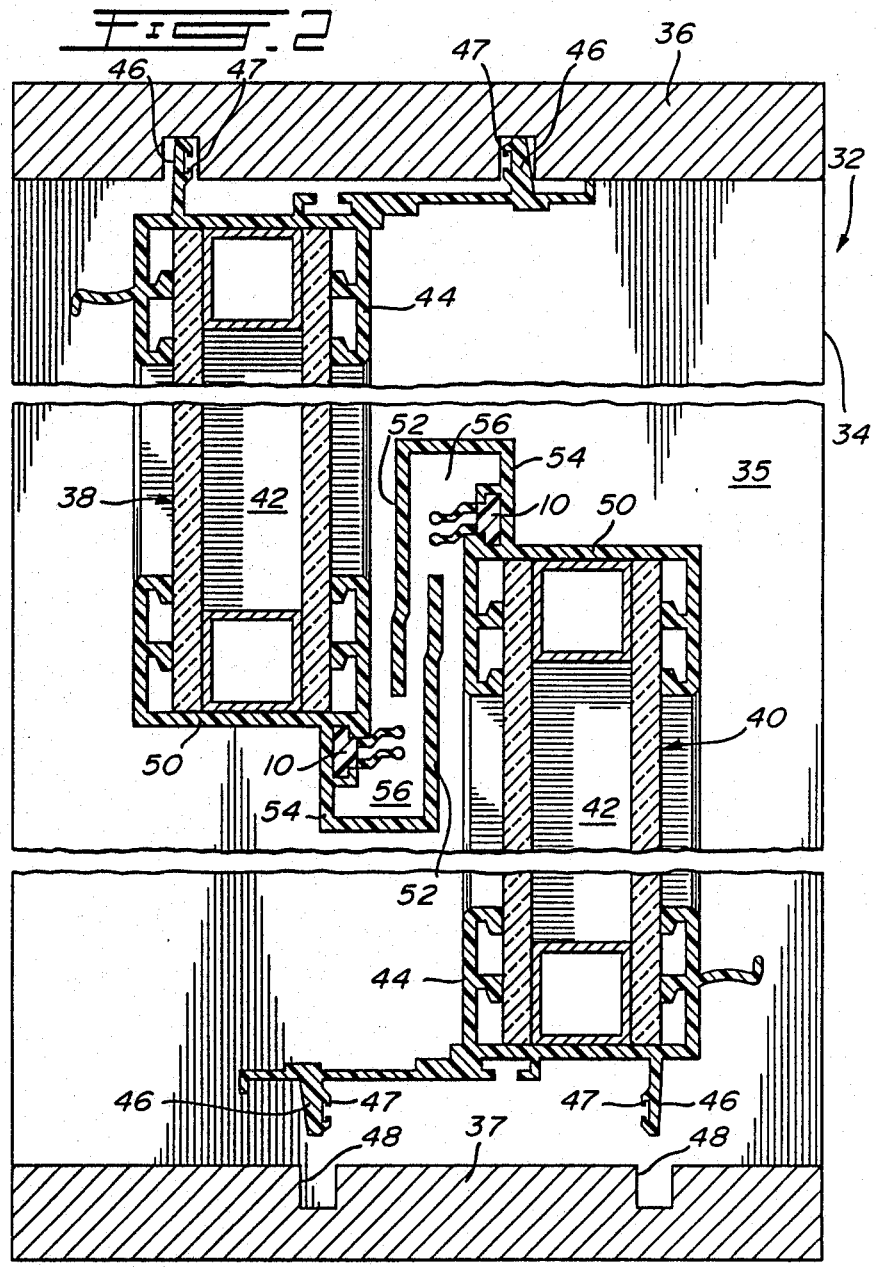
FIG. 2 is a horizontal sectional view through a window having sliding panels, in which the weather-strip according to the invention has been installed, one of the panels being ajar.

FIG. 2 shows a domestic window with sliding panels into which the weather-strip according to the present invention has been incorporated. The window, which is generally identified by the reference numeral 32, comprises a rectangular frame including a sill member 35 and two vertical uprights 36 and 37, respectively, mounted at the ends of the sill 35. In completing the structure of the frame, use is also made of a head member which connects the upper ends of vertical uprights 36 and 37. The head member is not shown in FIG. 2 since the actual structure of frame 34 is not a part of the present invention and since frames of this type are well known to those skilled in the art.

Mounted in frame 34 is a pair of sliding panels 38 and 40 respectively, panel 38 being in the closed position whereas panel 40 is slightly ajar.

Each panel comprises of a double glazing element 42 preferably sealed and mounted in a rectangular frame made of plastic material. The frame proper comprises a vertical upright 44 equipped with a pair of tongues 46 which come to rest in grooves 48 arranged in the frame upright against which vertical upright 44 rests when the panel is in the closed position.

The frame of each sliding panel also comprises a meeting upright 50 which is provided with a projecting tongue 52 held to upright 50 by means of an angle piece 54. Projecting tongue 52 and angle-piece 54 of each meeting upright define a deep groove 56 in which is accommodated the projecting tongue 52 of the adjacent meeting upright.

In the interior of each groove 56 is formed a retainer in the form of a groove adapted to receive the weather-strip 10 according to the present invention. The weather-strip 10 is mounted in the groove in such a manner that sealing wings 20 and 22 extend at right angles with respect to the projecting tongue 52.

Figure 3:
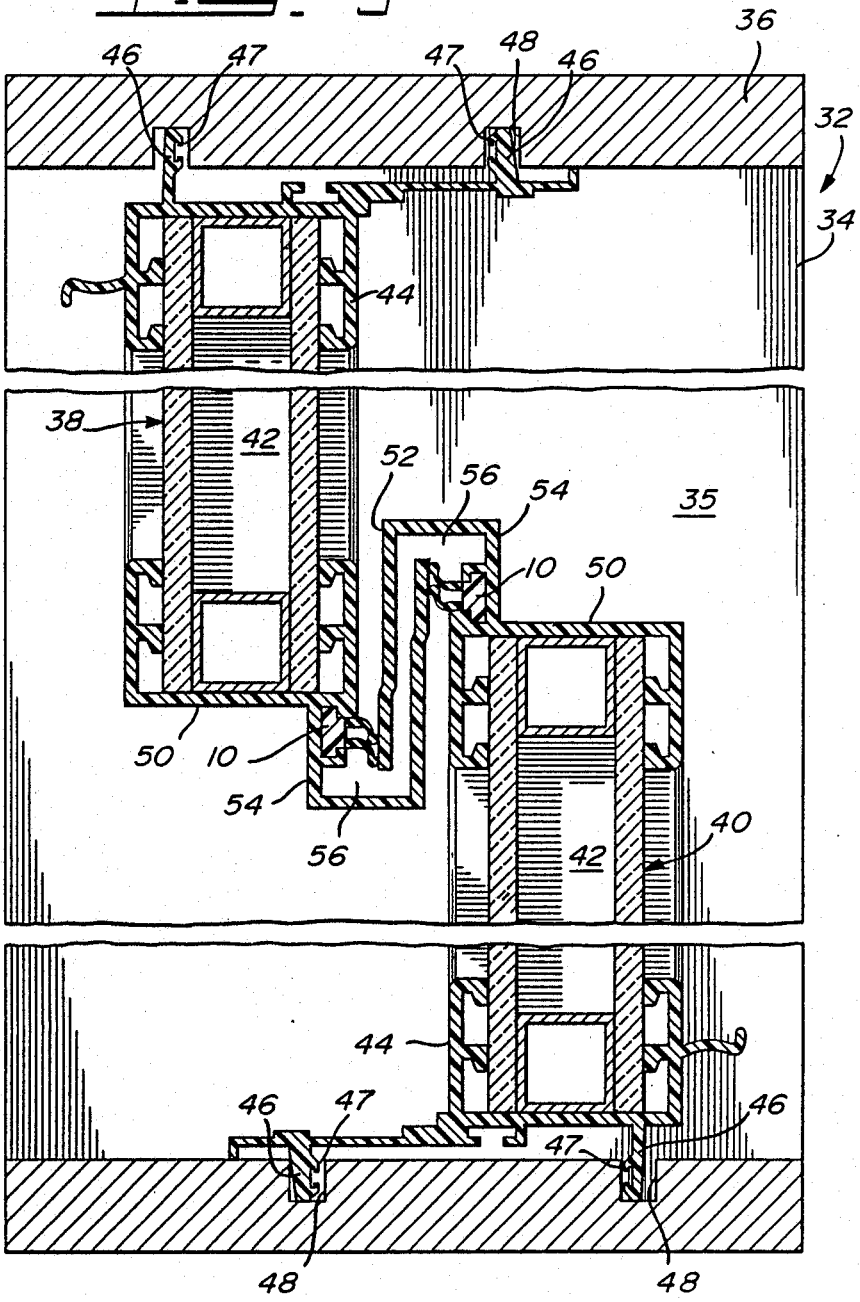
FIG. 3 shows the window illustrated in FIG. 2, the two sliding panels being in the closed position.

In this way, when sliding panels 38 and 40 are in the closed position, as shown in FIG. 3, the two wings 20 and 22 on each weather-strip 10 bear against the tongues 52 in such a manner as to enclose an air-space which acts as a thermal barrier and thus makes it possible to reduce the entry of air into the interior of the dwelling.

Curved intermediate portion 24 plays an important role since it allows outer portion 26 of each wing to flex easily in relation to inner portion 22 as projecting tongues 52 move into and out of their respective grooves 56. In other words, the curved intermediate portion 24 constitutes a hinge allowing the wing to flex laterally upon engagement of the outer sealing portion 26 by a projecting tongue in translational motion, thus, the wings of weather-strip 10 do not oppose undue resistance to the movement of the sliding panels.

It is obvious that the use of weather-strip 10 according to the invention is not restricted to the meeting uprights of sliding doors or windows. For instance, it would be easy to imagine a weather-strip 10 mounted to the tongues 46 of the sliding panels 38 and 40, for the purpose of obtaining satisfactory heat-insulation not only between the meeting uprights of the sliding panels, but also between the uprights of the frame 35 and uprights 44 of the sliding panels. For example, on each tongue 46 may be formed a retainer such as a groove 47 to hold a weather-strip 10, whose wings 20 and 22 bear against the inner walls of the groove 48 in which the tongue 46 is accommodated.

In producing weather-strip 10 according to the invention, recourse may be add to well-known co-extrusion processes comprising simultaneous extrusion of the supporting base 12 and of the wings 20 and 22 which are secured thereto at the outlet of the extrusion die. This process is relatively well known to those skilled in the art and it will therefore not be described in detail, all the more since it is not a part of the present invention.

The choice of the materials from which weather-strip 10 is made is relatively important to the success of the invention.

Base 12 should be made of a material which is sufficiently rigid to allow the weather-strip to be held firmly and to provide adequate support for the wings. The material should be as resistant as possible to longitudinal shrinkage and should also be flexible enough to resist splitting at low temperatures. Polyvinyl-chloride (PVC) is an example of a suitable substance. As regards wings 20 and 22, a plastic material compatible with the plastic substance of the supporting base should be selected for these properties at the said extreme temperatures. The material must remain flexible even at low temperatures of the order of −30° C. and it must have enough body to maintain its original shape at normal temperatures of 20° to 30°. For example, it is possible to use a composite of plasticized PVC and a synthetic rubber in various proportions in order to meet the required temperature conditions.

The following table provides, by way of example only, a data-sheet for the two materials used to produce a particularly advantageous embodiment of the invention.

| Characteristics | Materials for the base | Materials for the wings |
|---|---|---|
| Resistance to cold | No breakage at -35° C. (24 hours) | No breakage at -35° C. (24 hours) |
| Resistance to heat | No deformation | No deformation |
| Thermal stability | 125 min, (DIN53881, 180° C.) | 118 min. (DIN53381, 180° C.) |
| Coefficient of linear elongation | $0.082 \times 10^{-3}$/°C. (VDE 0304 par. 4 part 1) | $0.084 \times 10^{-3}$/°C. (VDE 0304 par. 4 part 1) |
| Density | 1.306 g/cm$^3$ (DIN 53479) | 1.146 g/cm$^3$ (DIN 53479) |
| Hardness (+3°) | 98° Shore A | 60° Shore A |
| Tensile Strength | 220 N/mm$^2$ (DIN 53504) | 119 N/mm$^2$ (DIN 53504) |
| Elongation at rupture | 250% (DIN 53504) | 420% (DIN 53504) |

-continued

| Characteristics | Materials for the base | Materials for the wings |
|---|---|---|
| Permanent deformation after storage in hot air under pressure | n.d. | maximum 13% (DIN 53517/1971 24 h, 70° C., constant load 5 bars/cm$^2$) |

The description of a preferred embodiment of the invention given hereinbefore is not to be regarded as restrictive but rather as an example, the purpose of which is to provide a better undernstanding of the invention. It is obvious that several modifications may be applied to this preferred embodiment without departing from the scope of the invention.

I claim:

1. For use with an air closure device of the type having two relatively movable members, a weather strip in the form of an extruded one-piece element adapted to be mounted between the two members of the closure device, said air closure device being of the type wherein one of said two members is movable by translation with respect to the other of said members, said weather-strip comprising:

a base made of a relatively rigid material; and two sealing wings made of a flexible and rubber-like material, said sealing wings extending in a direction generally perpendicular to the direction of translational movement of said one of said members, said sealing wings being connected to and extending side by side from said base and being slightly spaced apart from each other, each sealing wing comprising:

(a) an inner portion connected to said base and projecting therefrom;

(b) an outer sealing portion having a free edge adapted to contact one of said members; and (c) a curved intermediate portion connecting said inner portion to said outer portion, said outer portion being offset in relation to said inner portion in a generally transversal direction to the wing, said curved intermediate portion constituting hinge means allowing said wing to flex laterally upon engagement of said outer sealing portion by a member in translational motion.

2. A weather-strip as defined in claim 1, wherein said base has the shape of an inverted T, said base comprising a supporting bar carrying a pair of generally horizontal arms, said sealing wings being mounted to said supporting bar.

3. A weather-strip as defined in claim 1, wherein said wings decrease gradually in thickness towards their respective trailing edges.

4. A weather-strip as defined in claim 3, wherein the trailing edge of each wing carries a bead.

5. In a door or window comprising a frame in which are mounted at least two panels, one of which is adapted to slide and to execute a translational movement in said frame, the sliding panel being provided with a projecting tongue extending along one of its edges, said projecting tongue being generally perpendicular to the direction of movement of said sliding panel, said projecting tongue being adapted to fit in a groove when said sliding panel is in the closed position, a space being defined between said tongue and said groove when said tongue fits in said groove;

a weather-strip to be mounted in said space, said weather-strip being in the form of a one-piece element made by coextruding two compatible plastic materials, said weather-strip comprising:

a relatively rigid base to be mounted in said groove;

two sealing wings made of a flexible material and being connected to said base, said sealing wings extending from said base side by side and being slightly spaced apart, each wing comprising:

(a) an inner portion connected to said base and projecting therefrom;

(b) an outer sealing portion;

(c) a curved intermediate portion which connects said outer portion to said inner portion, said inner portion and said outer portion being located in respective planes which are essentially parallel with each other and being slightly spaced apart, said planes being generally perpendicular to the direction of movement of said sliding panel when said projecting tongue enters said groove, said wings engaging said projecting tongue to enclose an air-space which acts as thermal barrier, said curved intermediate portion constituting hinge means allowing said wing to flex laterally upon engagement of said outer sealing portion by said sealing panel in translation motion.

6. Weather-strip for a door or a window including at least one sliding panel movable by translation into a frame to a closed position in which an edge of said sliding panel meets an elongated member, said elongated member and said edge defining a pair of mating elements, said weather strip comprising:

an elongated base made of a relatively rigid material;

two sealing wings made of a relatively flexible material and being mounted to said elongated base generally transversely to the direction of translational movement of said sliding panel, said wings extending side by side from said base being slightly spaced apart, each sealing wing comprising:

(a) an inner portion connected to said base and projecting therefrom;

(b) an outer sealing portion; and (c) a curved intermediate portion connecting said outer sealing portion to said inner portion, said outer sealing portion being offset with respect to said inner portion in a generally transverse direction with respect to said sealing wing, said weather strip being adapted to be mounted to one of said mating elements, said sealing wings being spaced apart from each other so as to define therebetween an air space which constitutes a thermal barrier when said sliding panel is in the closed position with said outer portion of each wing engaging the other of said mating elements, the curved intermediate portion of each wing constituting hinge means allowing the wing to flex laterally upon engagement of the outer sealing portion thereof by said other of said mating elements in translational motion.

7. A weather-strip as defined in claim 6, wherein said mating element being of the tongue and groove type, said weather-strip being adapted to be mounted to said tongue.

8. A weather-strip as defined in claim 6, wherein said mating elements being of the tongue and groove type, said weather-strip being adapted to be mounted in said groove.

9. A window, comprising:

a frame;

two glazed panels, at least one of said panels being movable by translation to a closed position in said frame wherein an edge of the movable panel meets an elongated member of said window and defines a gap with said elongated member, said elongated member and said edge defining a pair of mating elements;

a weather-strip for mounting in said gap, said weather strip including:

(a) a base made of a relatively rigid material; and (b) two sealing wings made of a flexible and rubber-like material, said sealing wings extending in a direction generally perpendicular to the direction of movement of said movable panel, said sealing wings being connected to and extending side by side from said base, said sealing wings being slightly spaced apart, each sealing wing comprising:

(i) an inner portion connected to said base and projecting therefrom;

(ii) an outer sealing portion having a free edge adapted to contact one of said members; and (iii) a curved intermediate portion connecting said inner portion to said outer portion, said outer portion being offset in relation to said inner portion in a generally transversal direction to the wing, said curved intermediate portion constituting hinge means allowing said wing to flex laterally upon engagement of said outer sealing portion by said movable panel in translational motion.

10. A window as defined in claim 9, wherein said weather strip is mounted between meeting uprights of said glazed panels.

* * * * *